United States Patent [19]

Herzog

[11] Patent Number: 4,885,894

[45] Date of Patent: Dec. 12, 1989

[54] CAP ALTERNATOR

[76] Inventor: Kenneth J. Herzog, 200 Mill Rd., Riverhead, N.Y. 11901

[21] Appl. No.: 145,380

[22] Filed: Jan. 19, 1988

[51] Int. Cl.[4] ..... B65B 57/02; B65B 7/28

[52] U.S. Cl. ..... 53/68; 53/314

[58] Field of Search ..... 53/76, 313, 314, 315, 53/316, 485, 393, 68; 198/463.4, 463.6, 531

[56] References Cited

U.S. PATENT DOCUMENTS 2,518,857 8/1950 Bell ..... 53/314

3,156,078 11/1964 Sterling ..... 53/315

3,460,312 8/1969 Stover ..... 53/315

3,550,240 12/1970 Bresley et al. ..... 53/313

*Primary Examiner*—Robert L. Spruill

*Assistant Examiner*—Beth Bianca

[57] ABSTRACT

A cap alternator feed device is provided for a capper machine and consists of a mechanism that will prevent deposition of a cap on a raised portion of a container that is at an elevation not lower than the container neck but will allow a cap to be placed onto the neck.

4 Claims, 1 Drawing Sheet

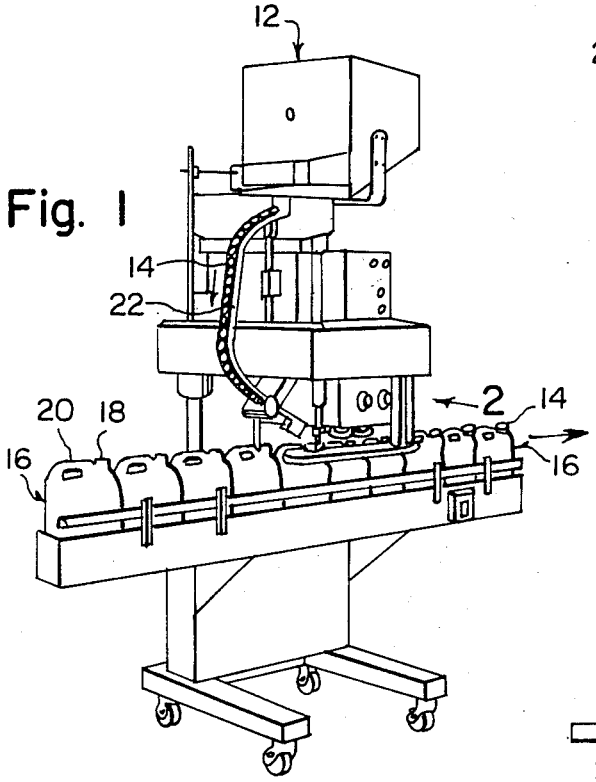
Fig. 1
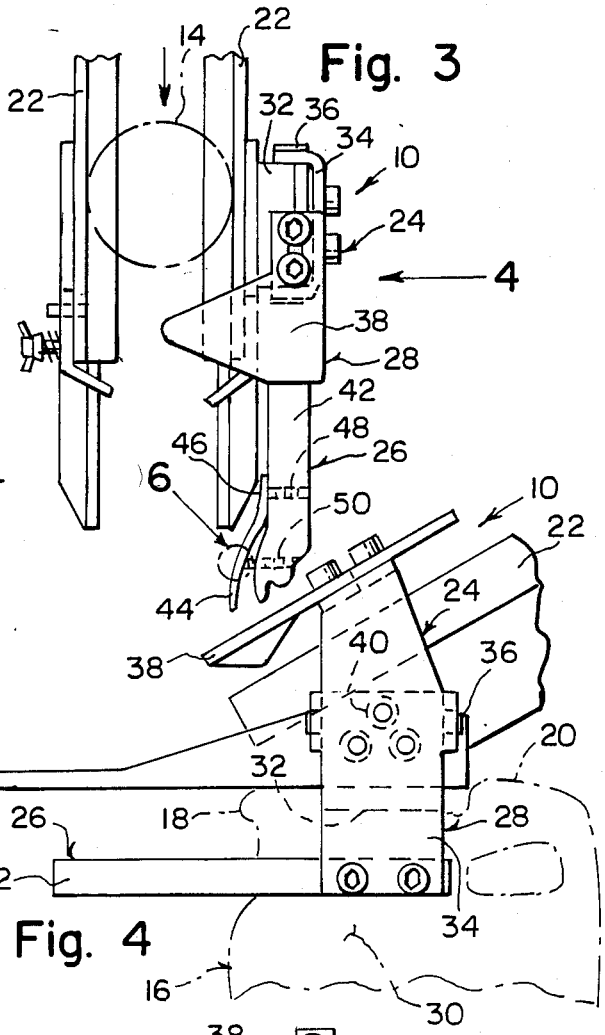
Fig. 3
Fig. 4
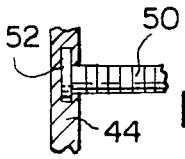
Fig. 6
Fig. 5
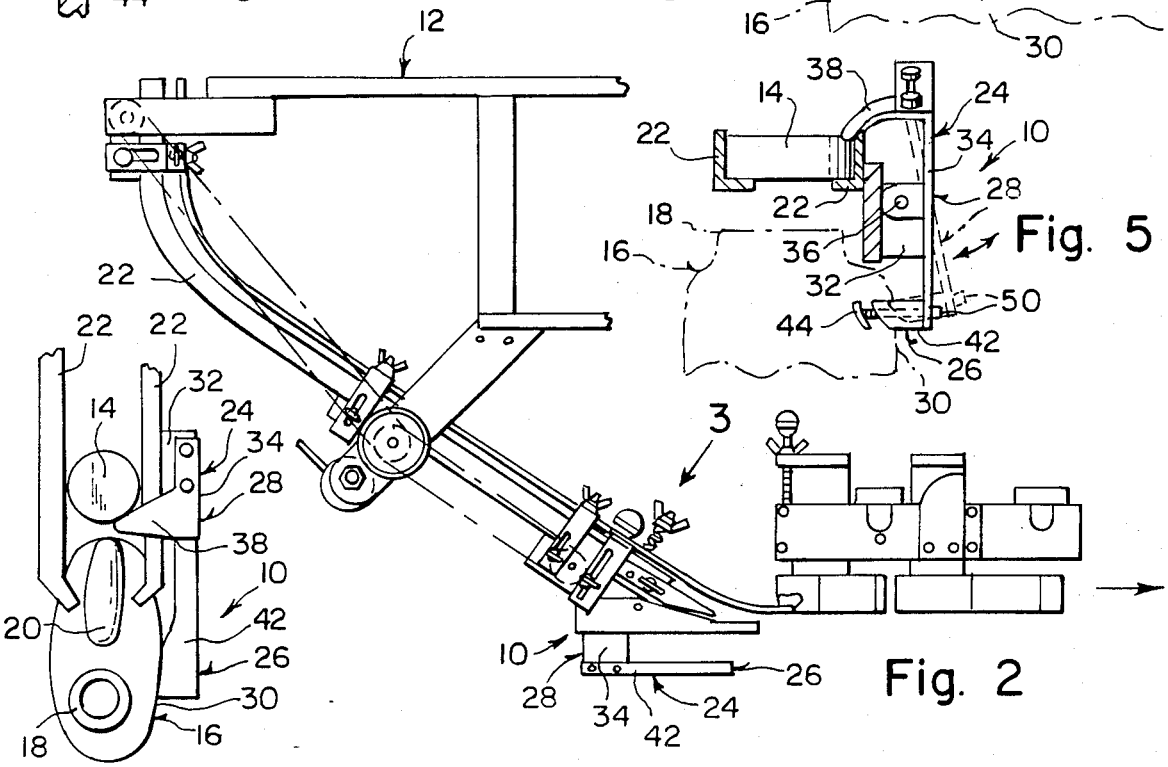
Fig. 2
Fig. 7

CAP ALTERNATOR

BACKGROUND OF THE INVENTION

The instant invention relates generally to capping machines and more specifically it relates to a cap alternator feed device.

Numerous capping machines have been provided in prior art that are adapted to place caps onto bottles and the like after the bottles have been filled with a product. While these units may be suitable for the particular purpose to which they address, they would not be as suitable for the purposes of the present invention as heretofore described.

SUMMARY OF THE INVENTION

A primary object of the present invention is to provide a cap alternator feed device that will overcome the shortcomings of the prior art devices.

Another object is to provide a cap alternator feed device that will prevent deposition of a cap on a raised portion of a container that is not lower than the neck but will allow a cap to be placed onto the neck.

An additional object is to provide a cap alternator feed device which is activated by a trigger responsive to contact with side of a container so as to engage a cap thus preventing deposition of the cap on the raised portion.

A further object is to provide a cap alternator feed device that is simple and easy to use.

A still further object is to provide a cap alternator feed device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a capper machine.

FIG. 2 is a side view taken in direction of arrow 2 in FIG. 1, of the lower cap chute and stabilizer assembly with the invention installed therein.

FIG. 3 is a top view taken in direction of arrow 3 in FIG. 2, showing the cap alternator feed device attached thereto with a cam lever adjustable to coact appropriately with varying container surfaces.

FIG. 4 is a rear view taken in direction of arrow 4 in FIG. 3, showing the cap alternator feed device attached thereto.

FIG. 5 is an end view showing movement of the cam lever responsive to container movement causing desired retention of a cap by a transverse tilting finger at a predetermined time.

FIG. 6 is a detail view as indicated by arrow 6 in FIG. 3, showing the adjusting cam lever rotatably connected to an a adjustment screw.

FIG. 7 is a top schematic view showing the position of a container with a cap on the container neck and the cap restrained finger preventing another cap from being deposited on container handle.

DETAILED DESCRIPTION OF THE PREFERRED EMBODIMENTS

Turning now descriptively to the drawings, in which similar reference characters denote similar elements throughout the several views, FIGS. 1 through 7 illustrates a cap alternator feed device 10 for a capper machine 12 that feeds caps 14 to containers 16 in which each container has a neck 18 to be capped and a raised portion 20, such as a handle or the like, not lower than the neck 18. The device 10 consists of a track 22 for overhead feeding of the caps 14 to the neck 18 in combination with a mechanism 24 for preventing desposition of a cap 14 on the raised portion 20.

The mechanism 24 includes a trigger 26 forward of the raised portion and a restrainer 28 which is activated by the trigger 26 responsive to contact with side 30 of the container 16 to engage the cap 14 on the track 22 preventing deposition of the cap on the raised portion 20.

The restrainer 28 includes a block 32 affixed to one side of the track 22. A bracket 34 is pivotly mounted at 36 to the block 32. A tilting restrainer finger 38 is affixed to top of the bracket 34 so that the finger 38 can extend over the track 22. A compression spring 40 is disposed between the block 32 and the bracket 34 to normally keep the bracket in a vertical non operative position. The trigger 26 includes an elongated horizontally extending cam arm 42 affixed to bottom of the bracket 34.

A flexible cam lever 44 can be affixed at its distal end 46 to the cam arm 42 with a mounting screw 48. The cam lever 44 is adjustable to coact appropriately with varying container side surfaces 30. An adjustment screw 50 is rotatably connected at 52 transversely to the cam lever 44 and then threadably extends through the cam arm 42 so that the adjustment screw 50 can adjust the cam lever to various positions with respect to the container side surface 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A cap alternator feed device for a capper machine that feeds caps to longitudinally spaced containers in which each container has a forward neck to be capped, a side and a longitudinally spaced rearward raised portion not lower than the neck, said device comprising a track for overhead feeding of the caps to the neck in combination with means for preventing deposition of a cap on said raised portion, wherein, said means is responsive to engagement with said container side at a point between said neck and said raised portion, wherein said preventing means includes a trigger forward of said raised portion and a restrainer which is activated by said trigger responsive to contact with said side of the container to engage the cap on said track preventing deposition of the cap on said raised portion, wherein said restrainer includes:

(a) a block affixed to one side of said track;

(b) a bracket pivotly mounted to said block;

(c) a tilting restrainer finger affixed to top of said bracket so that said finer can extend over said track; and (d) a compression spring disposed between said block and said bracket to normally keep said bracket in a vertical non operative position.

2. A cap alternator feed device as recited in claim 1, wherein said trigger includes an elongated horizontally extending cam arm affixed to bottom of said bracket.

3. A cap alternator feed device as recited in claim 2, further comprising a flexible cam lever affixed at its distal end to said cam arm, said cam lever being adjustable to coact appropriately with varying container side surfaces.

4. A cap alternator feed device as recited in claim 3, further comprising an adjustment screw rotatably connected transversely to said cam lever and threadably extending through said cam arm so that said adjustment screw can adjust said cam lever to various positions with respect to the container side surface.

* * * * *